United States Patent [19]

Obergfell

[11] Patent Number: 4,998,544

[45] Date of Patent: Mar. 12, 1991

[54] COMBINATION HEADBAND AND PONYTAIL HOLDER

[76] Inventor: Stephen D. Obergfell, 5134 E. 65th St., Indianapolis, Ind. 46220

[21] Appl. No.: 444,414

[22] Filed: Dec. 1, 1989

[51] Int. Cl.[5] ..... A45D 7/02

[52] U.S. Cl. ..... 132/212; 2/209.3

[58] Field of Search ..... 132/273, 212; 2/DIG. 11, 209.1, 209.3; D2/512, 513, 514, 515

[56] References Cited

U.S. PATENT DOCUMENTS

| | | | |
|---|---|---|---|
| D. 42,913 | 8/1912 | Drullard | D2/515 |
| 986,728 | 3/1911 | Lee | 132/212 X |
| 2,106,570 | 1/1938 | Lipton | 2/209.3 |
| 2,119,330 | 5/1938 | Hirsh | 2/209.3 |
| 4,499,741 | 2/1985 | Harris | 2/DIG. 11 X |
| 4,723,325 | 2/1988 | Perry | 2/DIG. 11 X |

*Primary Examiner*—Gene Mancene
*Assistant Examiner*—R. Thomas Price
*Attorney, Agent, or Firm*—Woodard, Emhardt, Naughton, Moriarty & McNett

[57] ABSTRACT

A combination headband and ponytail holder includes a headband adapted for encircling a person's head and a ponytail holder attached to the headband, the headband and ponytail holder defining aligned apertures for reception of the person's ponytail therethrough.

6 Claims, 2 Drawing Sheets

COMBINATION HEADBAND AND PONYTAIL HOLDER

BACKGROUND OF THE INVENTION

1. Field of the Invention

The present invention relates to the field of devices for retaining a person's hair, particularly for purposes of fashion or during exercise, and particularly to a headband having a novel provision of an incorporated ponytail holder.

2. Description of the Prior Art

Headbands have been provided in the prior art for a variety of purposes. In the most basic form, headbands typically comprise a single band of elastic, absorbent material sized to encircle the wearer's head. Headbands have both an aesthetic and a utilitarian function. Ponytail holders have also existed in the prior art to assist in controlling long hair and for purposes of fashion. However, the present invention is based upon a novel combination of these heretofore separate devices.

In U.S. Pat. No. 3,184,758, issued to Hirsch on May 25, 1965, there is disclosed a headband made of knit yarns and having portions specifically for covering the user's ears. A band of elastic fabric with an absorbent paper fabric covering is disclosed in U.S. Pat. No. 4,833,734, issued to Der Estephanian on May 30, 1989. In U.S. Pat. No. 4,499,741, issued to Harris on Feb. 19, 1985, there is disclosed a stretchable headband with a special provision for displaying a design thereon, whether in the stretched or unstretched condition.

Various utilitarian features have been incorporated into headband designs of the prior art. For example, in U.S. Pat. No. 4,365,354, issued to Sullivan on Dec. 28, 1982, there is disclosed a headband with a pocket formed by reflective material adhered to the band with velcro fasteners. A combination headband and shade visor, with the visor being received in a pouch of the band to be readily removable therefrom, is described in U.S. Pat. No. 4,293,958, issued to Zauner on Oct. 13, 1981.

SUMMARY OF THE INVENTION

Briefly describing one aspect of the present invention, there is provided a combination headband and ponytail holder which includes a first flat band adapted for encircling a person's head, the band including an aperture for receiving a ponytail therethrough, and a second band adapted for encircling and holding a person's ponytail, the second band being attached to the first band and defining a second aperture aligned with the first aperture and sized to receive the ponytail therethrough. The first and second bands are selectively adjustable, and may comprise, for example, an elastic material.

It is an object of the present invention to provide a device which combines the features of a headband and a ponytail holder in one unit.

Another object of the present invention is to provide a combination headband and ponytail holder which is simple and inexpensive in design.

It is a further object of the present invention to provide a combination headband and ponytail holder which is functional and aesthetically pleasing.

Further objects and advantages of the present invention will become apparent from the description of the preferred embodiment which follows.

DESCRIPTION OF THE PREFERRED EMBODIMENT

Figure 1:
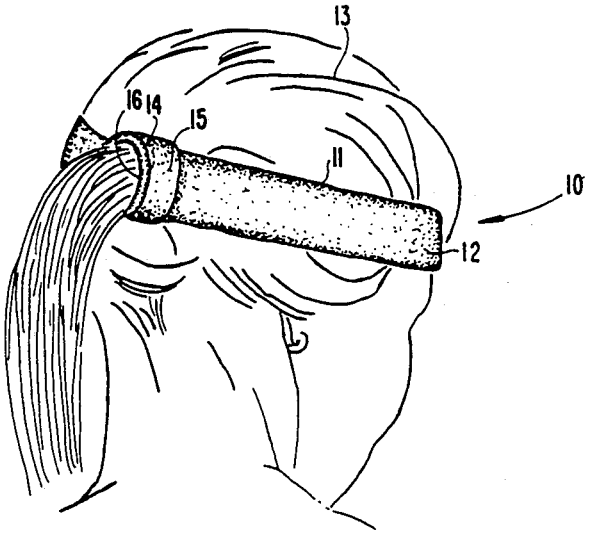
FIG. 1 is a perspective view of a combination headband and ponytail holder according to the present invention, shown as it is worn by a person.
Figure 3:
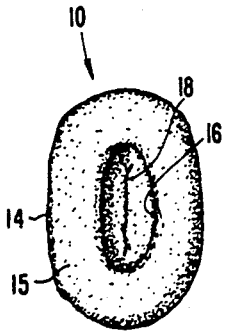
FIG. 3 is a rear elevational view of the combination headband and ponytail holder of FIG. 2.
Figure 2:
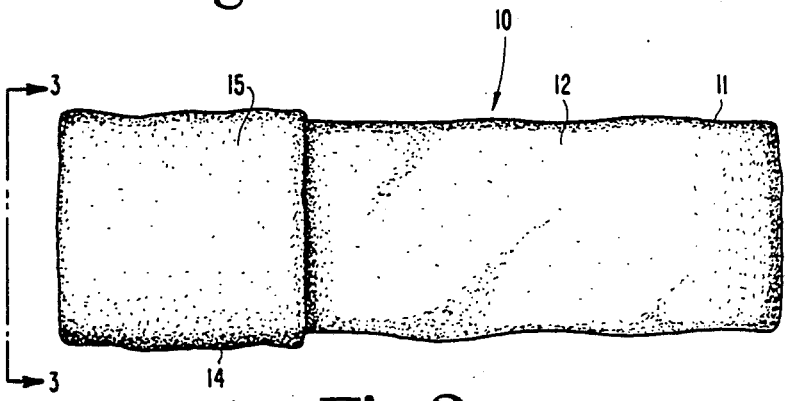
FIG. 2 is a right side, elevation view of the present invention, showing the headband in an unexpanded condition.
Figure 4:
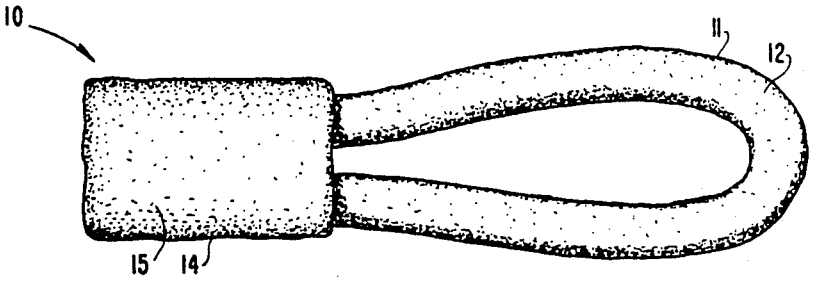
FIG. 4 is a top plan view of the combination headband and ponytail holder of FIG. 2.
Figure 5:
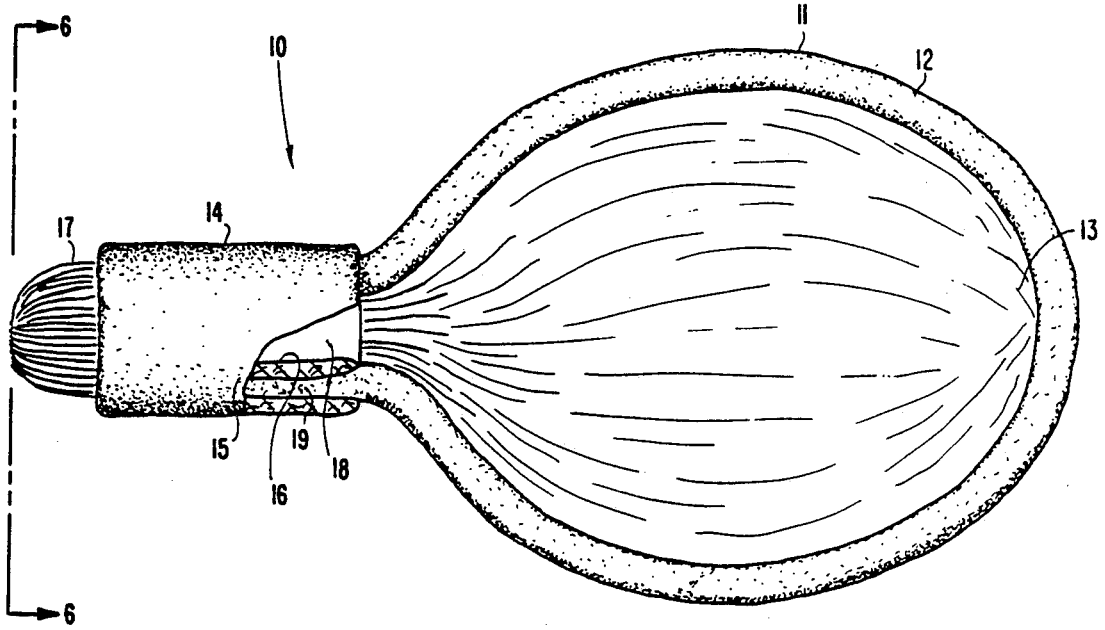
FIG. 5 is a top plan view of the headband and ponytail holder of the present invention, shown in an expanded condition as when worn by a person.
Figure 6:
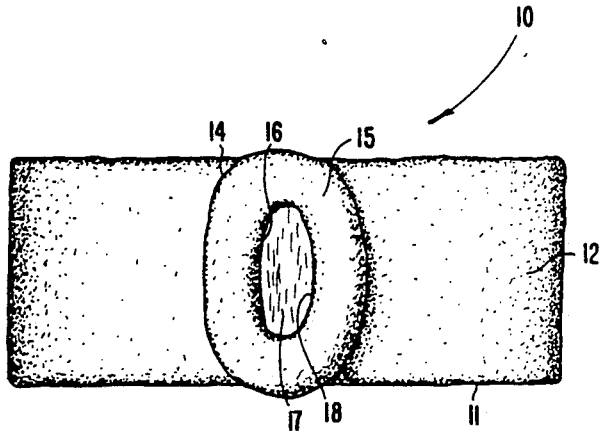
FIG. 6 is a rear elevational view of the combination headband and ponytail holder of FIG. 5.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown a combination headband and ponytail holder 10 constructed in accordance with the present invention. The holder 10 includes a headband 11 comprising a first flat band 12 adapted for encircling a person's head 13. The first band 12 includes attachment means for selectively adjusting the size of the headband to be snugly received about the person's head. Various such means are well known, including velcro portions, pin and hole arrangements, straps and buckles, and the like. It is preferred, however, that the first band be comprised of an elastic material such that the band may be stretched in conventional fashion to fit onto the user's head.

The holder 10 further includes a ponytail holder 14 attached to the headband 11. The ponytail holder 14 comprises a second band 15 defining an aperture 16 adapted for encircling and holding a person's ponytail 17. The second band 15 includes attachment means for selectively adjusting the size of the band to snugly retain therein the person's ponytail. Various such adjusting means may be utilized, although it is preferred for the band to comprise a flat band of an elastic material which is stretched over the ponytail and holds it therein.

The headband 11 includes an aperture 18 which is sizable to receive a person's ponytail therethrough. It will be appreciated that the aperture may be provided by means of a discontinuous portion of the band, either in the form of a hole in the band or a permitted displacement of the two ends of the band. For example, as shown in the drawings the band 12 includes two ends, such as 19, which are attached to the ponytail holder 14. By means of this attachment, the headband defines an aperture between the two ends of the band.

Also as is apparent from the drawings, the aperture 18 in the headband is aligned with the aperture 16 defined by the ponytail holder. The apertures 16 and 18 are aligned and receive the user's ponytail therethrough. In this fashion, the ponytail holder 14 functions to retain the ponytail while the headband is configured to receive the ponytail therethrough.

The headband 11 and ponytail holder 14 may be formed from a variety of materials suitable for the intended application. Various fabrics are particularly well adapted for use in this manner, including those which are moisture absorbent. Also as indicated, it is desirable for the materials to be elastic to facilitate functioning of the device in the described fashion. It is particularly convenient to have the headband 11 and ponytail holder 14 made of the same material.

The method of attachment of the two bands is readily selected from known techniques. In the simplest form, the ponytail holder 14 is a relatively flat band of material formed in the shape of a donut, and stitched together as needed. The headband may similarly comprise a flat band having ends which are secured to the interior portion of the donut-shaped ponytail holder by stitching.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A combination headband and ponytail holder which comprises:

an elastic headband consisting of a first flat band adapted for encircling a person's head, said first band being sustantially continuous, but including a first aperture sized to receive a ponytail therethrough, and an elastic ponytail holder consisting of a second continuous, circular, elastic band adapted for encircling a person's ponytail, said second band defining a second aperture sized to receive a ponytail therethrough, said second band being attached to said first band with the second aperture aligned with the first aperture, said second band including second attachment means for selectively adjusting the size of said second band to snugly retain therein the person's ponytail.

2. The invention of claim 1 in which said first band is comprised of a fabric material.

3. The invention of claim 1 in which said first band is comprised of a moisture absorbent material.

4. The invention of claim 1 in which said second band is comprised of a fabric material.

5. The invention of claim 4 in which said first band is comprised of a fabric material.

6. The invention of claim 5 in which said first band and said second band are comprised of the same material.

* * * * *